US005439262A

United States Patent [19]

Fuss et al.

[11] Patent Number: 5,439,262

[45] Date of Patent: Aug. 8, 1995

[54] LOCKING/RELEASE MECHANISM FOR A PIVOT BOLT OF A CLOSED-CIRCUIT DOOR OPENER

[75] Inventors: Fritz H.. Fuss, Albstadt; Augustin Toma, Balingen, both of Germany

[73] Assignee: Fritz Fuss GmbH & Co., Albstadt, Germany

[21] Appl. No.: 114,963

[22] Filed: Sep. 2, 1993

[30] Foreign Application Priority Data

Sep. 2, 1992 [DE] Germany ..... 42 29 239.5

[51] Int. Cl.[6] ..... E05B 15/02

[52] U.S. Cl. ..... 292/341.16; 292/201; 292/336

[58] Field of Search ..... 292/341.16, 341.17, 292/220, 224, 201, 239, 336; 74/2, 569; 384/276

[56] References Cited

U.S. PATENT DOCUMENTS

| | | | |
|---|---|---|---|
| 3,211,850 | 10/1965 | Toepfer | 292/341.16 X |
| 3,819,215 | 6/1974 | Fuss | 292/201 |
| 4,211,443 | 7/1980 | Butts et al. | 292/341.16 |
| 4,237,711 | 12/1980 | Kambic | 292/223 X |
| 4,406,487 | 9/1983 | Stendal | 292/201 |
| 4,697,442 | 10/1987 | Stendal | 292/346 |
| 4,815,776 | 3/1989 | Fuss | 292/341.16 |
| 4,986,584 | 1/1991 | Logas | 292/341.16 |
| 5,118,150 | 6/1992 | Jarrett | 292/341.16 |

*Primary Examiner*—Peter M. Cuomo
*Assistant Examiner*—Monica E. Millner
*Attorney, Agent, or Firm*—Oblon, Spivak, McClelland, Maier & Neustadt

[57] ABSTRACT

A locking/release mechanism for a pivot bolt of a closed-circuit door opener with a safety catch for the pivot bolt, which is controlled by an electromagnet. In order to reliably ensure release of the pivot bolt, even if a person has exerted strong pressure thereon prior to the cutting out or interruption of the magnet current, a locking lever is positioned between the electromagnet and the safety catch. The locking lever has a two-armed construction, one arm being provided with a stop member for engaging with the safety catch and the other arm being in the form of the electromagnet armature. The effective contact surface between the safety catch and the stop member is constructed in such a way that there is a wedge-like displacement action on the stop member through the safety catch.

5 Claims, 2 Drawing Sheets

LOCKING/RELEASE MECHANISM FOR A PIVOT BOLT OF A CLOSED-CIRCUIT DOOR OPENER

BACKGROUND OF THE INVENTION

The invention relates to a locking/release mechanism for a pivot bolt of a closed-circuit door opener with a safety catch for the pivot bolt, which is controlled by an electromagnet.

Unlike in the case with normal door openers having an operating current function, with closed-circuit door openers the pivot bolt is movable when the electromagnet is currentless or dead and the door can be opened. If the closed-circuit door opener magnet is live, the safety catch is stopped by the action of the electromagnet, so that a closed door cannot be opened. However, if the circuit is cut or interrupted in the case of a power failure, the pivot bolt is freed, so that the door can be opened and closed in random manner.

Such closed-circuit door openers operate in a very reliable manner. However, in exceptional circumstances, where a person exerts a strong pressure on the pivot bolt prior to the cutting out or interruption of the magnet current, there is a risk of the lever mechanism jamming, which prevents the release of the pivot bolt.

SUMMARY OF THE INVENTION

The object of the invention is consequently to provide a locking/release mechanism of the aforementioned type, which also reliably ensures a release of the pivot bolt, if a person exerts a strong pressure on said pivot bolt prior to the cutting out or interruption of the magnet current.

This object is achieved in that between the electromagnet and the safety catch a locking lever is provided, which is constructed as a two-armed rocking lever and is pivotably mounted axially parallel to the safety catch, one arm of the locking lever being constructed as the armature of the electromagnet and the other arm being provided with a stop member for engaging with the safety catch and the effective contact surface between the safety catch and the stop member is constructed in such a way that also when uninterrupted pressure of the safety catch occurs on the stop member at the time of a power supply interruption to the electromagnet, a wedge-like displacement action occurs on the stop member via the safety catch.

The advantage of the invention is that with a single movable part, namely the pivotable locking lever, combined with the safety catch, a reliable locking/release of the pivot bolt is ensured. When the electromagnet is dead, there is no possibility of the cooperating parts jamming. Particularly in the case of panic when an uninterruptedly strong pressure is exerted on the pivot bolt, the safety catch is immediately released if the power supply is interrupted.

According to a preferred development of the invention the stop member comprises a bush mounted in a rotary manner. Therefore, the safety catch can roll on the stop member, so that the frictional forces are minimized.

To ensure that the locking lever cannot be brought e.g. by a blow or impact on the lock, briefly from the locked position into the open position, it is appropriate for the locking lever to be resiliently pretensioned towards the locked position.

According to a further preferred development of the invention the two arms of the locking lever are oriented substantially perpendicularly to one another and the bearing point of the locking lever is at the intersection of the two arms. This leads to a space-saving arrangement, which can be incorporated in simple manner into a door opener casing.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENT

Figure 1:
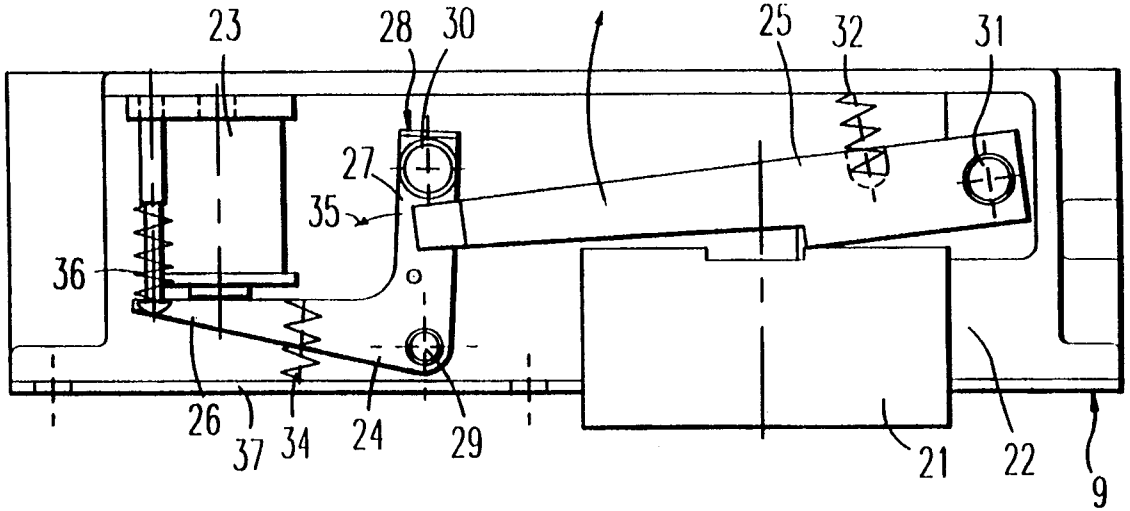
FIG. 1 diagrammatically shows a cross-section through a closed-circuit door opener with a live electromagnet and FIG. 2 diagrammatically shows a cross-section through a closed-circuit door opener with a dead electromagnet.

In the drawings shown a door opener casing 9 for housing all the components. To make the drawings easier to understand, those door opener parts which are not directly linked with the locking/release mechanism for a pivot bolt are neither shown, nor described.

In a known manner the pivot bolt 21 is deflectably mounted about a pivot pin or axis 22 located in the plane of the drawing. From the locking position shown in the drawing it can be moved by pivoting out of the plane of the drawing into the release position.

It is subject to the action of a safety catch 25, whose pivot axis 31 is perpendicular to the drawing plane and is pretensioned with a spring 32 against the pivot bolt 21.

The locking/release mechanism also comprises an electromagnet 23 and a locking lever 24 pivotably mounted axially parallel to the safety catch 25. The locking lever 24 has a two-armed construction, one arm being constructed as the armature 26 of the electromagnet 23 and on the other arm 27 is provided a stop member 28 for engaging with the safety catch 25. FIG. 1 shows the locked postion of the safety catch 25 and the locking lever 24, in which the armature 26 engages directly on the electromagnet 23 and the stop member 28 is in the pivoting path of the safety catch 25. In the live state the electromagnet 23 maintains the locking lever 24 in the position shown, so that a pivoting movement of the safety catch 25 in the direction of the arrow into its release position and therefore a deflection of the pivot bolt 21 is impossible.

Figure 2:
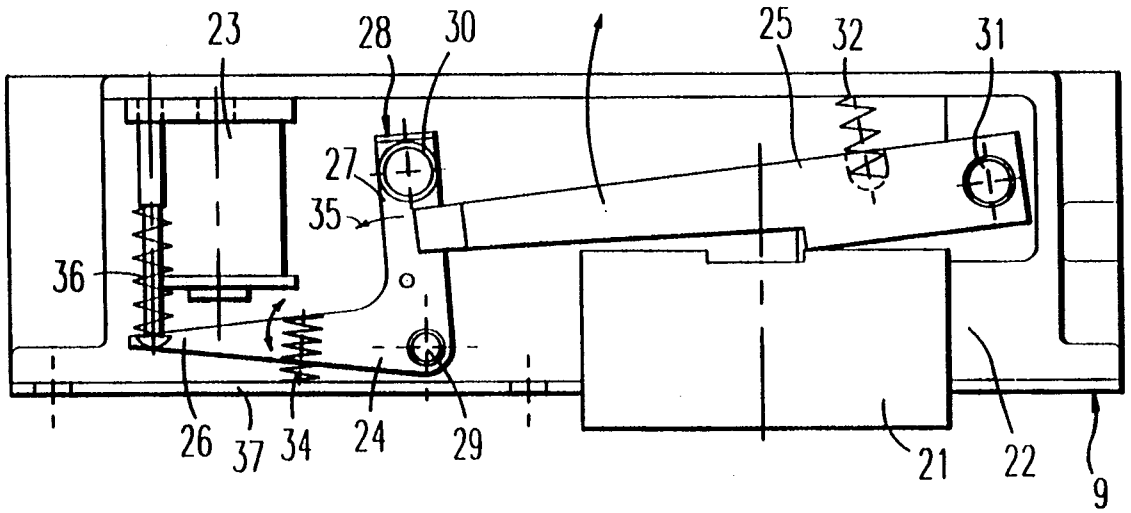

FIG. 2 shows the position of the locking lever 24 in the dead state of the electromagnet 23. A second spring 36 acts on the locking lever 24 against a first spring 34 in such a way that when the magnet 23 is dead it is positioned in an intermediate position. It can then be easily pivoted in the direction of the electromagnet 23 and a locked position or in the direction of the casing wall 37 away from the electromagnet 23 and a release position. The armature 26 is mounted in the intermediate position between the electromagnet 23 and the casing wall 37 without touching the electromagnet 23 and the casing wall 37.

The arm of the locking lever 24 forming the armature 26 runs substantially parallel to the longitudinal wall of the casing and the arm 27 carrying the stop member 28 is oriented substantially horizontally at right angles to the casing longitudinal wall. The armature 26 is pretensioned towards the locked position by a spring 34 in which it engages on the electromagnet 23. The stop member 28 comprises a rotatably mounted bush 30. The locking lever is pivotably mounted axially parallel to the safety catch 25 by means of a pin 29 at the intersection of its two arms.

If the electromagnet 23 becomes currentless, then the armature 26 is no longer secured. In the case of pressure being applied on the pivot bolt 21, even if this pressure existed prior to current disconnection, the free end of the safety catch 25 moves the bush 30 away, accompanied by the pivoting of locking lever 24 in accordance with the arrow 35, so that the safety catch 25 of the pivot bolt 21 can in an unimpeded manner move to the left into the release position.

The bush 30 and the free end of the safety catch 25 cooperate in such a way that a displacement action of said catch is exerted on the bush 30. The cylinder casing of the bush 30 deflects the latter in the manner of a V-flat drive, the friction being minimized by rolling action of the bush.

If the locking lever 24 is only released at a time when somebody is already attempting to open the door opener of the associated door by strong pressure on the pivot bolt 21, it is not necessary for the pressure to be reduced or completely removed following interruption of the supply voltage of the electromagnet. Even in these circumstances jamming is prevented and the action point of the safety catch 25 on the bush 30 traverses a path excluding any locking action.

It is finally to be understood that although the preferred embodiment of the present invention has been described, various other embodiments and variations may occur to those skilled in the art which fall within the scope and spirit of the invention, and such other embodiments and variations are intended to be covered by the following claims.

What we claim is:

1. A locking/release mechanism for a pivot bolt of a closed-circuit door, which comprises:

a safety catch for the pivot bolt, the safety catch being pivotable about a first pivot axis;

an electromagnet for controlling the safety catch;

a locking lever located between the electromagnet and the safety catch wherein the locking level comprises a two-armed rocking lever which is pivotable about a second axis which is axially parallel to the first pivot axis of said safety catch, a first arm of the locking level comprising an armature of the electromagnet and a second arm of the locking lever including a stop member for engaging with the safety catch wherein a contact surface between the safety catch and the stop member is provided such that when uninterrupted pressure from the safety catch occurs on the stop member upon occurrence of a power supply interruption to the electromagnet, a wedge-like displacement action on the stop member also occurs via the safety catch and wherein the stop member comprises a bush rotatably mounted on the second arm.

2. A locking/release mechanism according to claim 1, which comprises a first spring for pretensioning the locking lever towards a locked position.

3. A locking/release mechanism according to claim 2, which comprises a second spring which biases the locking lever against the pretensioning by the first spring in such a way that the locking lever is positioned in an intermediate position so that, as required, the locking lever is pivotable towards a locked position of the electromagnet or in a release direction.

4. A locking/release mechanism according to claim 1 wherein the first and second arms of the locking lever are oriented substantially perpendicular to one another and the locking lever has a pivot point which is located at the intersection of the first and second arms.

5. A locking/release mechanism according to claim 1, which comprises a tensioning device for subjecting one of the first and second arms to tension.

* * * * *